US005117599A

United States Patent [19]

Voss

[11] Patent Number: 5,117,599

[45] Date of Patent: Jun. 2, 1992

[54] PANEL CONNECTOR ARRANGEMENT FOR OFFICE FURNITURE DEMOUNTABLE WALL PANEL SPACE DIVIDER SYSTEMS

[75] Inventor: Roy N. Voss, Elgin, Ill.

[73] Assignee: Allsteel Inc., Aurora, Ill.

[21] Appl. No.: 531,400

[22] Filed: May 31, 1990

[51] Int. Cl.[5] ..... E04H 1/00

[52] U.S. Cl. ..... 52/238.1; 52/239

[58] Field of Search ..... 52/239, 238.1, 36, 741

[56] References Cited

U.S. PATENT DOCUMENTS

| | | | |
|---|---|---|---|
| Re. 32,890 | 3/1989 | DeFouw . | |
| 3,430,997 | 3/1969 | Propst | 52/239 |
| 3,517,467 | 6/1970 | Propst et al. . | |
| 4,443,986 | 4/1984 | Propst et al. . | |
| 4,567,698 | 2/1986 | Morrison . | |
| 4,581,869 | 4/1986 | Reuter . | |
| 4,993,205 | 2/1991 | Dull | 52/239 |

*Primary Examiner*—David A. Scherbel
*Assistant Examiner*—Creighton Smith
*Attorney, Agent, or Firm*—Lee, Mann, Smith, McWilliams, Sweeney & Ohlson

[57] ABSTRACT

A panel connector arrangement for office furniture demountable wall panel space divider systems wherein the individual panels are of the familiar quadrilateral configuration and include at each of the panel side edges a rectilinear side frame member in the form of a side channel extending continuously between the upper and lower ends of the panel and defining a planar web disposed between a pair of side frame member planar shoulders, with the connector arrangement involved being for use in removably joining to a free standing or fixed upright such panel an unattached such panel, and free of any post or other standard between such panels that are in coplanar relation, with the connector arrangement involved comprising a clamp device having a pair of relatively movable bodies forming opposed clamping heads shaped and positioned relative to indexing apertures formed in the upper ends of the side frame members of all the panels to be so secured, a discrete bottom seating hook, and associated indexing apertures formed in such panel side frame members adjacent the lower end of same for seating the free unattached panel on the free standing or fixed panel and swinging the unattached panel so that its side frame shoulders seat against the side frame shoulders of the fixed panel, with the clamp device heads being formed for disposing the clamp device heads in clamping relation to the panel side frames involved longitudinally thereof, whereby such panel side frames are anchored to each other, and the side frame of the panel being mounted is clamped against the seating hook.

5 Claims, 4 Drawing Sheets

PANEL CONNECTOR ARRANGEMENT FOR OFFICE FURNITURE DEMOUNTABLE WALL PANEL SPACE DIVIDER SYSTEMS

This invention is concerned with office furniture demountable wall panel space divider systems, and more particularly, to the provision of a panel connecting arrangement for same, whereby the panels employed for this purpose are secured together panel to panel fashion, with a panel or the panels of such a system that are free standing in an upright mounted position in some conventional manner being employed to so secure thereto similar unattached panels as needed to complete the work station being formed.

It is common practice in this field to, using freestanding demountable wall panels, subdivide a relatively large interior space into what have become known as work stations that are furnished with the usual shelves, cabinets, work space providing structures, and the like.

A familiar form of panel employed for this purpose is generally quadrilateral in shape (usually rectangular) and is composed of the usual core (which may be of one of the various types known to this art) to either side of which may be suitably secured a skin that may be of metal or plastic, with the panel core suitably mounting the usual top, bottom and side frame piece members that are of generally channel shape. A familiar type of side frame member commonly employed for this purpose is in the form of a channel member that includes a web extending longitudinally thereof and indented toward the panel core, with the web being disposed between a pair of coplanar shoulders at the side edges of the frame member that may be formed with a row of elongate apertures that are conventionally adapted to receive conventional hooks for cantilevering a work station component from either side of the panel of which the side frame member is a part, after the formation of the work station as such is completed.

The invention of the present application has the purpose of providing an arrangement for securing or anchoring to a freestanding panel of this type an unsecured or fresh such panel to extend and/or complete a wall for work stations or the like, with such panels being secured together in abutting relation along their adjacently disposed side frame pieces by clamping action that acts longitudinally of the side frame members of adjacent panels, and with the freestanding nature of the mounted panel being passed on to the added panel, while providing a panel subdividing system that may be readily disassemble moved, and reassembled as needs change, and while eliminating the need for the post or standard between coplanar of such panels that has heretofore been required between the coplanar panels so secured.

A principal object of the invention is to provide an arrangement for releasably securing panels of this type of divider system together for permanent use of the work station, for enlargement of same, or for ready disassembly and reassembly of same at another location using the same panels and securing arrangement therefor.

Other important objects of the invention are to provide an arrangement for securing together at their adjacent margins panels of the type referred to, to extend and/or form a planar panel wall, and to use only at panel wall corners, or at the juncture of panel subdivider systems of, for instance, the familiar "X", "T", or ninety degree type, configurations, an appropriately shaped post in association with such panel securing arrangement.

In accordance with the invention, the panel connector arrangement comprises a clamp device having a pair of relatively movable, opposed and similar but reversely shaped heads that in use are respectively positioned relative to the tops of the panel side frame members involved, and indexing apertures provided in the upper portions of the side frame members involved (of the panels being secured together), with the objective of securing the freestanding panel to the unattached panel by fixing the two adjacent side frame members of same together by a form of clamping action acting longitudinally thereof that results in the two side frame members being secured together and clamped in place. The arrangement involved includes a discrete bottom seating hook, and associated indexing apertures formed in the lower portions of side frame members involved, for seating the free panel on the fixed panel, and swinging the free panel in mounting same for securement so that its so seated side frame abuts against the side frame of the fixed panel, with the clamp device heads being formed for disposing the clamp device upper clamping head in clamping relation to the upper ends of both side frame members involved; the panel connector arrangement also includes at its seating hook a locking projection that permits easy adjustment of the unattached panel relative to the mounted panel side frame, and that is disposed for effecting binding engagement with the unattached panel side so seated frame member under the clamping action provided by the clamping device, and when the unattached panel side frame member is at the desired elevational position relative to the freestanding panel side frame member for clamping purposes, free of any supplemental post or other standard between such side frame members of the panel, that are to be in coplanar relation. At space divider system corners, and for space divider systems of the familiar ninety degree, "X", or "T" shape (for instance), suitably contoured filler posts are employed and are secured in place by employing the new panel connector arrangement in a similar manner.

Other objects, uses, and advantages will be obvious or become apparent from a consideration of the following detailed description and the application drawings, in which like reference numerals indicate like parts throughout the several views.

In the drawings:

FIG. 1 is a fragmental diagrammatic perspective view illustrating fragments of two adjacent conventional panels and their side frame forming, channel shaped members, that are shown facing each other, which panels are of a conventional type commonly used in this art at the present time, and have been formed with the indexing apertures of this invention;

FIG. 2 is an enlarged fragmental vertical sectional view, taken essentially along line 2—2 of FIG. 1 (with the panel cores omitted) and looking in the direction of the arrows, illustrating the two panels shown in FIG. 1 secured together in coplanar relation, with their adjacent side frame members in essentially coextensive abutting, relation, utilizing the panel connector arrangement of the present invention, including the bottom or lower seating hook embodiment that is shown in the lower portion of FIG. 2, with the mid portion of FIG. 2 being broken away to permit the enlarged showing of the upper and lower portions of FIG. 2 that are provided;

Figure 2:
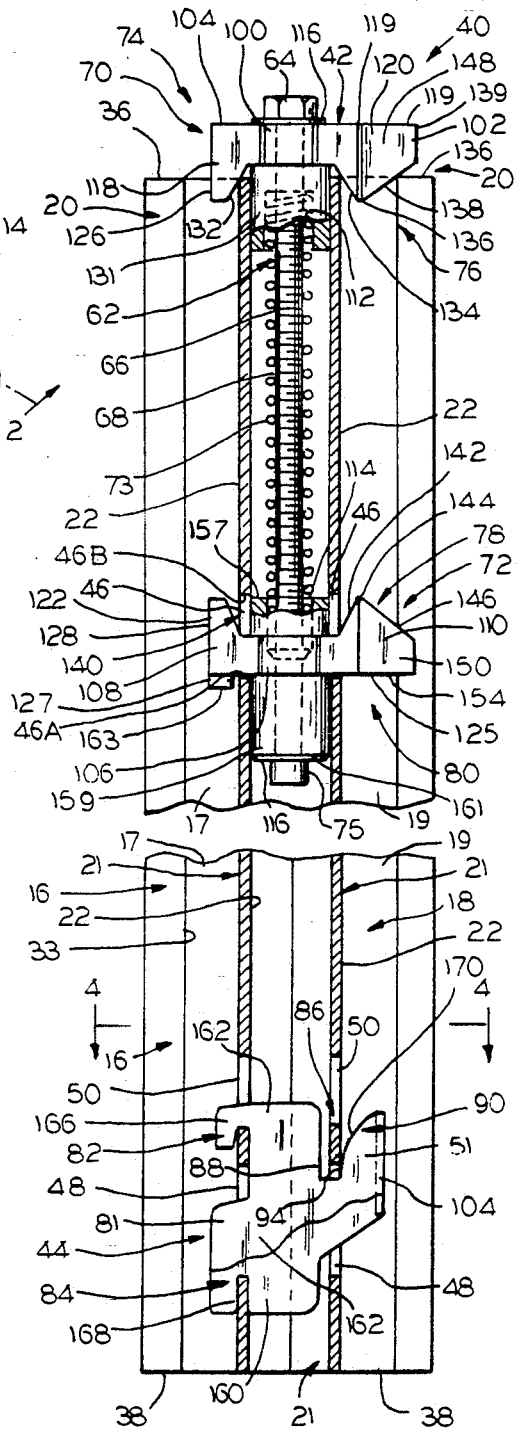
Figure 6:
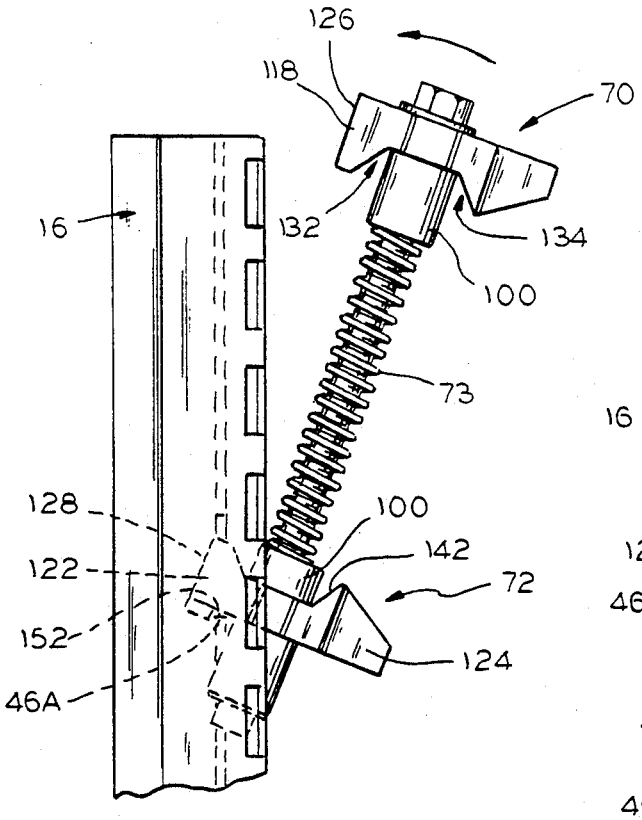
Figure 7:
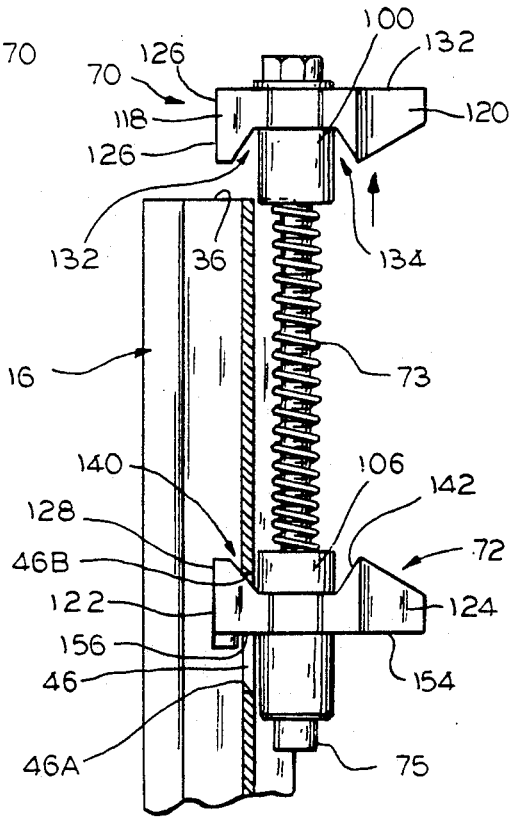
Figure 9:
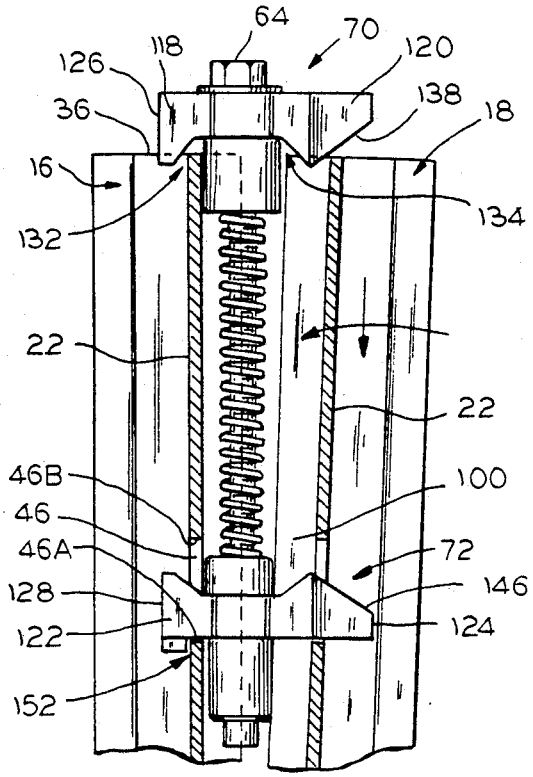
Figure 9:
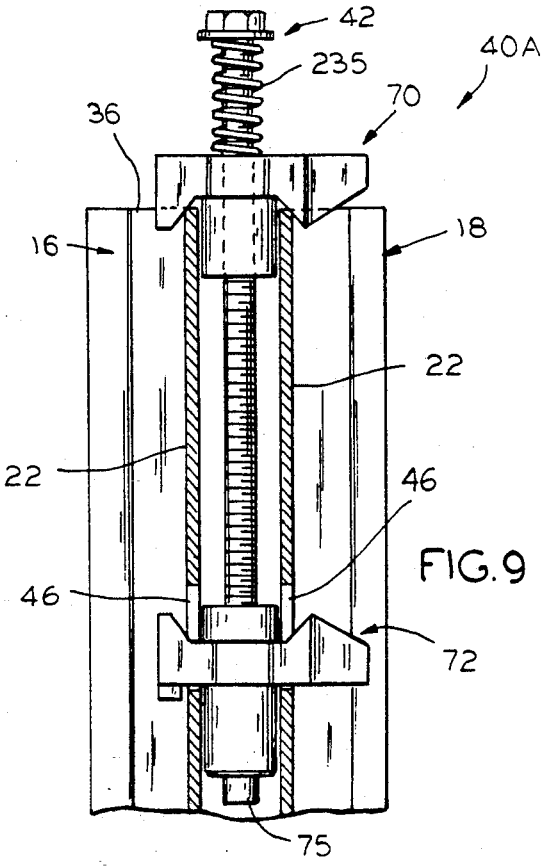
Figure 8:
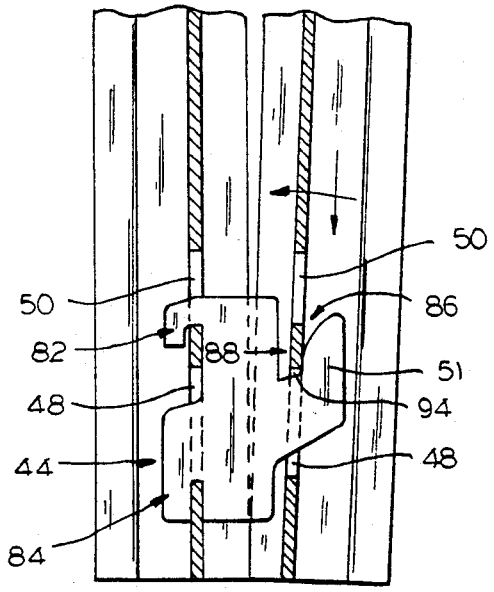
Figure 10:
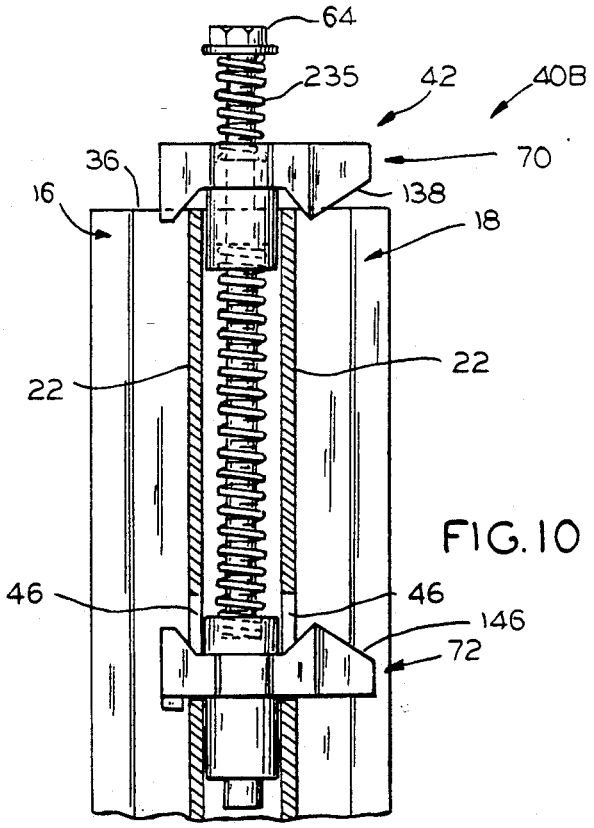

FIGS. 6, 7 and 8 are views similar to that of FIG. 2, showing the manner in which the invention clamp device is shifted, and the free or fresh panel is manipulated, to bring its side frame member defining channel member into abutting relation with the corresponding side frame member of the free standing or mounted panel (where such panels are to be put in coplanar relation), for application of the clamping action of the clamp device that results in the securement of the two panels together, with the upper ends of their side frame members aligned horizontally, as indicated in FIG. 2;

FIGS. 9 and 10 are similar to the upper portion of FIG. 2, but illustrate modified forms of the clamp device involved, with the respective clamp devices being shown in a nonclamping relation with regard to the tops of the panel side frames being connected, to better illustrate the modifications involved.

Figure 11:
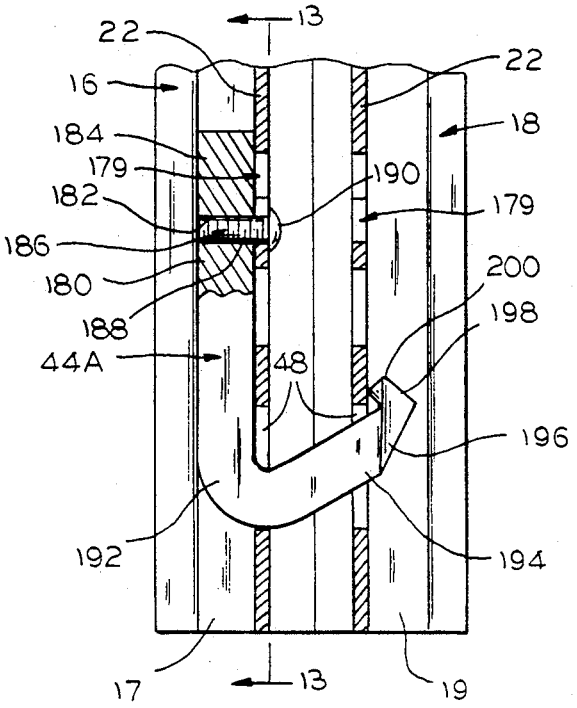
Figure 12:
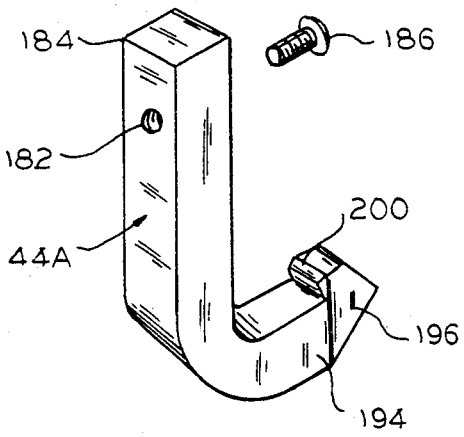
Figure 13:
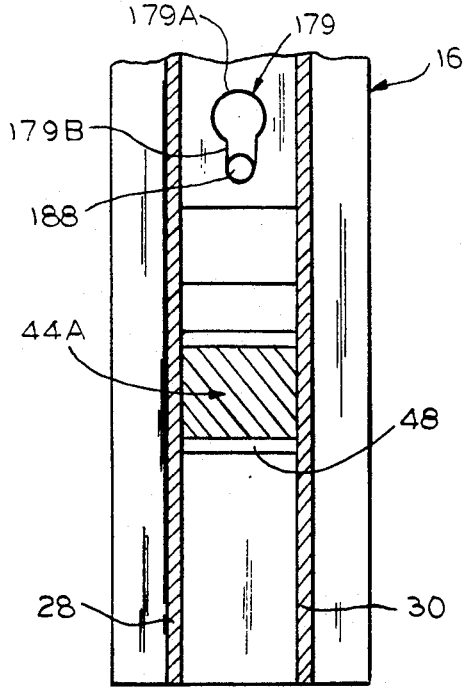
Figure 14:
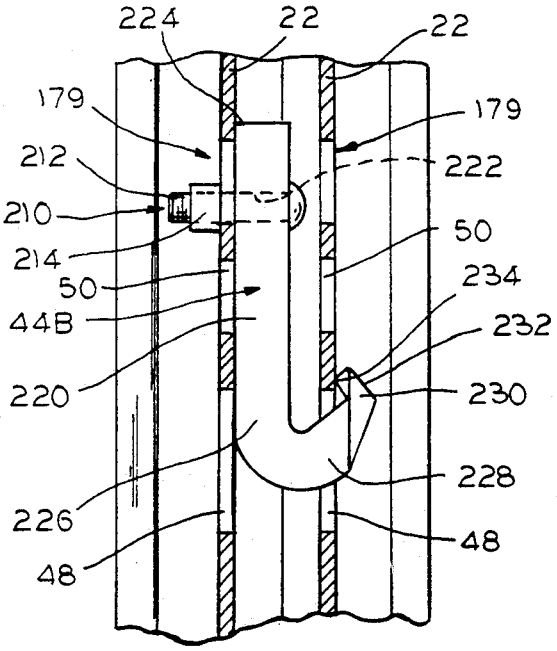

FIG. 11 is similar to the lower portion of FIG. 2, illustrating a modified bottom hook arrangement in accordance with the invention;

FIG. 12 is an exploded perspective view of the bottom hook arrangement of FIG. 11 and an associated mounting screw therefor;

FIG. 13 is a vertical sectional view substantially along line 13—13 of FIG. 11, illustrating more particularly the keyhole shaped opening of the panel side frame member to which the bottom hook of FIGS. 11 and 12 is anchored; and FIG. 14 is a diagrammatic view similar to that of FIG. 11 illustrating a further modified hook arrangement in accordance with the invention.

However, it is to be distinctly understood that the specific drawing illustrations supplied are provided primarily to comply with the requirements of the patent Laws, and that the invention is susceptible of other embodiments or modifications that will be readily apparent to those skilled in the art, and which are intended to be covered by the appended claims.

GENERAL DESCRIPTION

Figure 1:
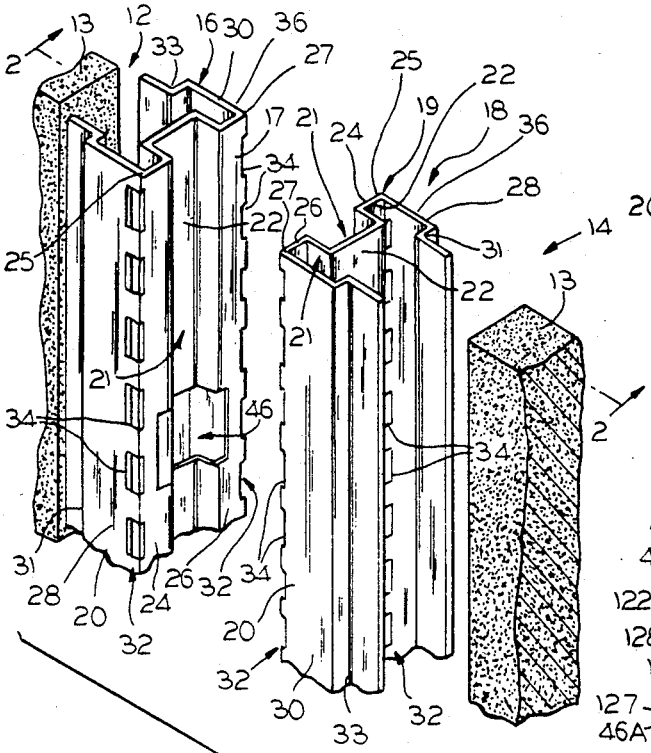

Referring first to the showing of FIG. 1, the panel connector arrangement of this invention is shown proportioned for use with conventional panels 12 and 14 (that are commonly used in connection with demountable wall panel space divider systems). As disclosed herein, the walls of the work station or the like are to be formed by the panels 12 and 14 being secured together in coplanar arrangement, with similar panels 12 or 14 (which are assumed to be identical) being secured in coplanar relation to form the resulting panel wall as needed to complete the panel wall of work stations or the like. At right or other angle corners, a suitable filler post is employed, and the panels adjacent same are secured to the filler in the same manner, and for work station or the like formation purposes, the panel wall arrangement formed can be of the familiar "X", "T", or ninety degree type configuration, as desired, using similar filler posts of suitable configuration.

In any event, it is assumed for purposes of this disclosure that the panel 12 is conventionally fixedly mounted in freestanding upright position in one of the manners known to this art, and that panel 14 is to be secured or anchored to same in coplanar relation thereto to likewise mount the panel 14 in its upright relation.

Panels 12 and 14 are assumed to be of one of the conventional types employed for this purpose, panels 12 and 14 being basically only diagrammatically illustrated, with each of the panels 12 and 14 including the usual core 13, and again only diagrammatically illustrated, since wood, plastic, etc. with or without sound deadening materials, are commonly employed for this purpose. Cores 13 may have applied to either side of same the usual skin of metal or plastic sheeting (not shown) that is conventionally applied coextensively thereto, with the resulting cores 13 suitably mounting the usual top, bottom, and side frame pieces of the panel that are commonly of the generally channel shape type.

As indicated, the present invention is concerned with the securing or anchoring, to a previously and suitably installed upright, so-called freestanding panel 12 that is in the usual upright relation, a second panel 14 of the same or a similar construction and in coplanar relation thereto.

The installed panel 12, in addition to its core 13, includes a side frame member 16 in the form of a side channel 17, while the panel 14 to be installed in accordance with the present invention includes in addition to its core 13, side frame member 18 in the form of side channel 19 that, in accordance with the invention, is to be secured to the side channel 17 to install panel 14 by so securing same to the panel 12 that has been previously installed. Panel 14 in the practice of the invention may be installed either in coplanar relation to the panel 12, or by using a suitably configured filler member as a connector post, in right angled or other relations to the installed panel 12 (as hereinbefore referred to), for the purpose of forming right angled and other angled corner work stations as well as providing space subdividing panel configurations of the familiar ninety degree, "X", and "T" configurations, for instance.

The side channels of the conventional panels referred to, including the side channels 17 and 19, are each of the conventional type comprising a formed sheet member 20 that is suitably formed to define a generally channel shaped configuration, including a planar web portion 22 that is centerally indented as at 21. Member 20 including its web portion 22 forms a pair of shoulders 24 and 26 (see FIGS. 3 and 4) that are at opposite side edge portions 25 and 27 of the member 20; member 20 also forms the respective side flanges 28 and 30 (see FIGS. 3 and 4) of the member 20 (that, in the form shown, are indented at 31 and 33 for shaping the respective flanges 28 and 30 for close fitting relation to the respective panel cores 13). The shoulders 24 and 26 of the respective members 20 (that are part of the respective panel members 12 and 14) are shown formed with a row 32 of elongate apertures 34 that are conventionally adapted to receive conventional hooks (not shown) for cantilevering familiar work station components such as a shelf, or cabinet, from either side of the panel from which the side frame member 20 is a part, as desired after the panels are mounted in upright relation as desired to form a work station or the like. The rows 32 of the respective members 20 (which may also be optionally on one side only of each member 20, or only on selected members 20), extend from the top ends 36 of the respective members 20 down the respective members 20 as needed in the direction of the lower ends 38 of same, as is conventional.

Referring now to the showing of FIGS. 2–8, the panel connector arrangement 40 that comprises the present invention includes the clamp device 42, discrete bottom or lower seating hook 44 (see FIG. 2, but note also the forms of FIGS. 11 and 14), indexing apertures 46 (see the upper portion of FIG. 2) of quadrilateral configuration formed in the web portions 22 of the respective members 20 that are equal in size and are spaced the same specific dimension below the tops 36 of the respective members 20, and seating hook mounting apertures 48 and 50 (see the lower portion of FIG. 2), also of quadrilateral configuration that are also formed in the web portions 22 of the respective channel members 20, which apertures 48 and 50 are of the different sizes and are respectively at the same specific dimensions above the lower ends 38 of the respective channel members 20. The seating hook 44 in the form of FIGS. 2–10 includes a finger portion 51 that is to be in a frictional binding relation with the channel member 20 of the panel 14 (the panel being mounted) when the channel members 20 of panels 12 and 14 are in full abutting relation at the shoulders 24 and 26 and are shifted into coextensive, top level relation, utilizing clamp device 42 that in effect clamps the channel members 20 of panels 12 and 14 together by clamping the channel member 20 of the panel being attached into the indicated binding relation with seating hook finger 51. The cast versions of seating hooks 44A and 44B shown in FIGS. 11–13, and FIG. 14, respectively, are similarly equipped, as disclosed hereinafter.

The clamp device 42 is screw actuated, and includes a threaded bolt 62 having top head 64, shank 66 that is externally threaded as 68, a bottom head 75, and a pair of special bodies or cross head members 70 and 72 (hereinafter sometimes referred to as heads) that are spaced apart longitudinally of the screw shank 66 and biased to that position by suitable means, such as the illustrated compression spring 73. The bolt heads 64 and 75, and its shank 66 are integral with bolt 62. The clamp device 42 is desirably power actuated, and has an outside or upper side 74 (see the upper portion of FIG. 2) and an inside or lower side 76 for body or head member 70, and an inside or upper side 78 and an outside or lower side 80 for the body or head member 72. The body of head member 72 is threadedly mounted on the shank 66 of bolt 62, while the body or head member 70 is rotatably mounted on the bolt shank 66, and thus is guided by threading 68 but is not in threaded engagement therewith. The bolt 62 bottom head 75 serves to limit the threaded movement of body or head member 72 away from bolt head 64; bolt head 64 is of the type adapted to be rotated by a conventional power drill or the like, as by bolt head 64 being of hex shape and suitably and conventionally detachably keyed to the drill, for achieving the clamping action involved.

Figure 3:
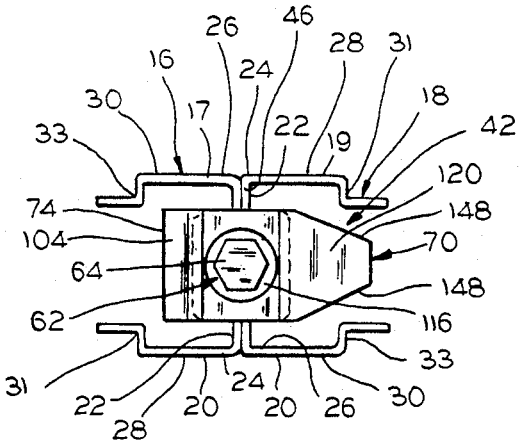
FIG. 3 is a top plan view of the panel connector arrangement and panel side frame members that are shown in FIG. 2.
Figure 4:
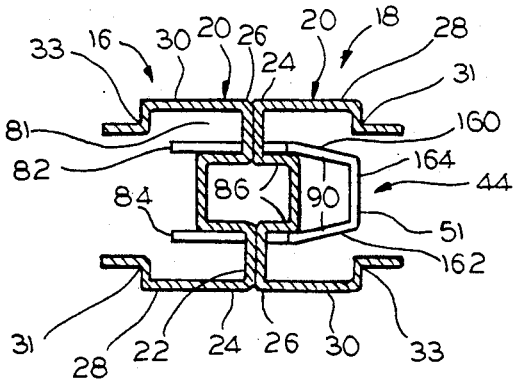
FIG. 4 is a horizontal sectional view taken along line 4—4 of FIG. 2, looking in the direction of the arrows, showing the FIG. 2 embodiment of the panel connector arrangement bottom seating hook, with the adjacent side frames of the demountable coplanar panels involved being shown in section (and the panel cores again omitted)

The seating hook 44 of FIGS. 2–10 is of the formed sheet metal type and has a body 81 shaped to define vertically disposed hook portions 82 and 84, in addition to finger 51, and adjacent the finger 51, an outwardly opening locking recess 86 that, in the form illustrated for this type of bottom hook, includes a lower and narrower rectilinear portion 88, and an upper wider portion 90 that diverges in width in an upwardly direction. The seating hook locking recess 86 defined by the seating hook body 81 has a lower or base margin 94 (see FIG. 2) that is part of finger 51 and is to be in binding engagement with the web portion 22 of channel member 20 of the side frame member 18. when the channel member 20 of side frame member 18 is in full engagement with the corresponding member 20 of panel 12 on the side frame sets of shoulders 24 and 26, as indicated in FIGS. 2–4, and the clamping action of clamp device 42 is effective, as hereinafter disclosed.

As to the clamp device head member 70 (see FIGS. 2 and 5), it will be noted that it includes a center section 100, and oppositely disposed side sections 102 and 104, respectively while as to the clamp device head member 72, it includes a center section 106 and oppositely disposed side sections 108 and 110, respectively.

The center sections 100 and 106 of the respective head members 70 and 72 are similar except that the bolt shank receiving aperture 112 of the head member 70 is proportioned for slip fit reception over the bolt shank threading 68, while the bore 114 of the head member 72 is suitably internally threaded for threaded engagement with the bolt shank threading 68. The bolt head 75 limits the rotational ability of head member 72 away from the bolt head 64, while compression spring 73 biases the head members 70 and 72 in spaced apart relation, and seats head member 70 either directly against the bolt head 64, or against suitable washer 116 that is interposed between the head 64 and member 70 in the illustrated embodiment of clamp device 42.

Figure 5:
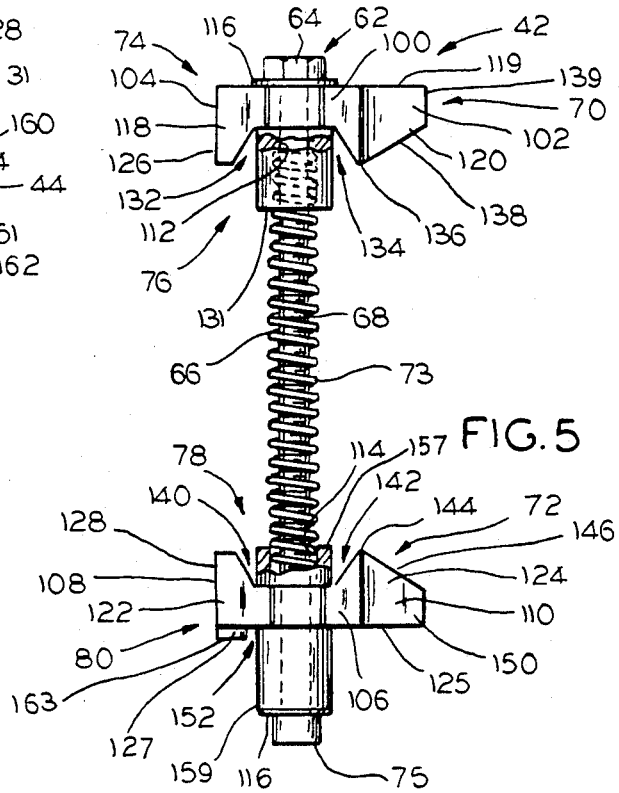
FIG. 5 is a plan view of the connector arrangement clamp device of the present invention, with its heads positioned as shown in FIG.

Referring now more specifically to the device 42 upper head member 70, its section 104 is formed to define upright but depending lobe 118, of five sided cross sectional configuration (in the plane of bolt 62 as device 2 is shown in FIG. 5), and its section 102 is formed to define cross lobe 120 that extends oppositely of lobe 118 and thus crosswise or transversely of bolt 62; sections 102 and 104 of head member 70 are oppositely disposed at either side of bolt 62. The head member 72 is similarly formed, its section 108 defining upright lobe 122 (that is similar to lobe 118 but extends toward head member 70), and cross lobe 124 that extends oppositely of the lobe 122 and is of the same size and shape as section 102 of head 70. It may be added that for facilitating manufacture, the basic exterior shaping of the respective head members 70 and 72 is made similar for cost saving purposes. The upper surfacing 119 of head member 70 (at the clamp device upper side 74) is planar, while the similar surfacing 125 of head member 72 at the clamp device lower side 80 is also planar except for the lower protrusion 127 (which is more specifically referred to hereinafter).

The lobes 118 and 122 of the respective head members 70 and 72 are proportioned at their respective planar end faces or surfaces 126 and 128 to be longer axially of bolt 26 or vertically than the indexing apertures 46, but of sufficient less width than apertures 46, as to readily pass heads 70 and 72 therethrough. Apertures 46 and heads 70 and 72 are both of a width to include a portion of the side frame member abutting shoulders 24 and 26 of the panel side frame members 16 and 18 to be secured together by the practice of the present invention to insure a firm clamping action provided by device 42. Apertures 46 are also located below the tops 36 of the respective channel members 20 a predetermined distance, as indicated hereinbefore; for instance, the upper ends 46B of the apertures 46 may be located three and one-half inches below the frame member tops 36, and the clamp devices 42 are proportioned lengthwise accordingly, for application of the heads 70 and 72 thereto. The respective lobes 118 and 122 each define the respective planar surfaces 126 and 128 that are employed to seat the clamp device 42 against the indented portion 22 of the mounted panel side frame member 20 in the initial positioning of the clamp device 42, as hereinafter described.

The head member 70, at the device 42 top side 74, is defined by planar surfacing 119 that extends across its sections 100 (except for aperture 112), 102 and 104, and thus extends transversely of the head aperture 112. The head member 70 at the clamping device underside 76 involves the head including projecting extension 131 of quadrilateral section (square in the illustrated embodiment of device 42) that also defines a portion of aperture 112, and depending lobe 118 being separated from center section 100 by deep V-groove 132; the cross lobe 120 thereof on the underside 76 thereof defines V shaped groove 134 that merges into the head corner edge 136 that is also formed by angled planar cam surfacing 138 that extends to planar surface 139 of its section 102.

As to the head 72, on the clamp device side 78 at lobe 122 it defines deep V-groove 140 that separates the lobe 122 from the head member center section 106, and on the other side of the center section 106, the cross lobe 124 defines V shaped groove 142 that merges into corner edging 144 which is in part defined by inclined cam surfacing 146. Center section 106 includes an upwardly projecting relatively short portion 157 and downwardly projecting relatively long portion 159 defining a planar end surface 161 against which a second washer 116 is engaged between it and head 75 of bolt 62 (the latter extending through head 72, as already indicated). The head portions 157 and 159 are preferably of square transverse cross-sectional configuration, with the head portion 159 being proportioned in thickness to be received in, but substantially fill, the space between the indented portions 21 of the web portions 22 of the panel side frame members 16 and 18 being secured together, in accordance with the invention; the head portion 157 preferably has a thickness that is less than such thickness. The long portion 159 also serves to block out the light that may pass through aligned apertures 34 for applications where a short panel 14 is to be secured to a standard length panel 14 and blank cross openings formed in panel side frame flanges 28 and 30 are opened up for this purpose.

As indicated by FIG. 3, the cross lobe 120 of the head member 70 defines on either side of same cam surfaces 148 that are similarly but oppositely angled with respect to the axis of the head aperture 112, while the lower head member 72 defines similar cam surfaces 150, which are the same as the respective surfaces 148, but only one of which is shown in the drawings.

The head member 72 on the device 42 side 80 at lobe 122 of head 72 defines cross groove 152 between protuberance 127 head portion 163 (protuberance 127 being of quadrilateral transverse cross-sectional configuration, as indicated in FIGS. 2 and 5), and transversely extending planar surface 125 that extends transversely of the axis of the head aperture 114. Corner edging 144 substantially parallels the plane of head surface 125.

With regard to the seating hook 44 version of FIGS. 2–10, as best shown in FIG. 4, the hook body 81 as illustrated comprises a length of metal sheeting, suitably formed from a suitable grade of steel or the like, that is shaped to define the U shaped configuration shown in FIG. 4 and thus comprises side portions 160 and 162 that are joined and separated by center portion 164, with the center portion 164 and the adjacent portions of the side portions 160 and 162 defining the finger 51. The hook side portions 160 and 162 are suitably formed as indicated in FIG. 2 to define a pair of upper hook portions 166 that together form hook portion 82, and lower recessed portions 168 that together form hook portion 84; hook portions 82 and 84 are to be applied through the indexing apertures 50 and 48, respectively, of the freestanding panel side frame member 16, and specifically its web 22, for application to its respective apertures 48 and 50, as will be described hereinafter The lower portions 170 of the upper surfacings of the sides 160 and 162 that define the finger 51 of seating hook 44 also define the rectilinear margins 94 of and on either side of the finger 51, in the illustrated embodiment, where the binding engagement of the frame member 18 and seating hook 44 are to take place.

Turning now to the cast versions of the invention bottom hook, namely hooks 44A and 44B, FIGS. 11–13 illustrate the bottom hook 44A, while FIG. 14 illustrates bottom hook 44B. In these Figures the panels, 2 and 14, and their side frames 16 and 18, are identical to those of FIGS. 2–10, except that at the panel side frame members 16 and 18, they are suitably formed to define keyhole shaped opening 179, just above the upper seating hook mount aperture 50, as shown in FIG. 13. The bottom seat hook 443 of FIG. 14 also requires the panel side frame members to be formed in this manner. The clamp device 42 used in connection with the bottom hook cast versions 44A and 44B may be the same as used in connection with hook 44.

The bottom hook 44A is formed from a suitable metal, such as zinc or a suitable grade of steel, or their equivalents, that is cast in the form of a hook defining elongate arm 180 having a threaded aperture 182 adjacent its upper end 184 that is to receive screw 186 defining threaded shank 188 and head 190. The elongate arm 180 adjacent its lower end 192 is curved hook fashion to define hook portion 194 that forms finger portion 196 having adjacent its upper end 198, on the inside of same, ledge portion 200 that is to serve to bindingly engage the side frame member 18 of the panel being fixed in place (as indicated in FIG. 11) similar to what is provided by finger 51 of hook 44 (see FIG. 2).

Bottom hook 44A, before panel securement starts using arrangement 40, is applied to the side frame 16 of the fixed panel 12, free of screw 186, by having its arm 180 inserted, with its finger portion 196 disposed upwardly, through the larger aperture 48 of the free standing panel side frame member 16 and moving the hook 44A to an upright position; the hook 44A is shifted until its aperture 182 is aligned with the circular portion 179A of keyhole shaped opening 179, after which screw 186 is turned into aperture 182. The hook 44A is then lowered to permit the shank 188 to enter the narrow portion 179B of opening 179 and rest on the side frame 16, and secrew 186 tightened in place to set its head 190 against the side frame member web 22, as indicated in FIG. 11, with the hook 44A then being fully supported by the side frame member 16 of the panel 12.

In the cast version 44B of the bottom hook that is shown in FIG. 14, the basic hook is similar to hook 44A except that its screw 210 is longer than screw 186, it is unthreaded except at the shank end 212, to which nut 214 is threadedly applied, spaced from the side frame member web 22, as needed, to receive the web 22. Nut 214 is proportioned to be slipped through the round portion 179A of opening 179, screw 210 and its nut being assembled to its bottom hook as indicated prior to application of the hook 44B as assembled to side frame members 16. Nut 214 is also proportioned to be freely received between the shoulders 24 and 26 of the panel side frame 16 to which it is applied.

Bottom hook 44B, in addition to its screw 210 and nut 214, thus comprises elongate arm 220 having aperture 222 (through which screw 210 is inserted) adjacent to its upper end 224. The bottom hook 443 also includes lower end 226 of arm 220, hook portion 228, finger portion 230 defining upper end 232, and ledge portion 234 that, respectively, serve the same functions as the corresponding portions of hook 44A.

Bottom hook 44B, before panel securement starts using arrangement 40, is applied to the side frame 16 of the fixed panel by slipping it between the shoulders 24 and 26 thereof, with the orientation indicated in FIG. 14, and then aligning its screw with the round portion 179A of keyhole shaped aperture 179 for slipping same therethrough, after which the hook 44B is lowered into keyhole opening narrow portion 179B to be supported by the panel side frame to which it has been applied, and screw 210 tightened in place.

Turning to the manner of use of the arrangement 40 with bottom hook 44, assuming that the side frame member 16 is part of the mounted or fixed freestanding panel 12, and it is desired to secure an unmounted panel 14 in coplanar relation with the mounted panel 12, the assembler applies the seating hook 44 to the indexing apertures 48 and 50 of the panel side frame member 16 in the position indicated in FIG. 2. In addition, the clamp device 42 is grasped by the assembler and its head members 70 and 72 placed in coplanar relation, essentially in the positioning shown in FIGS. 2 and 5-7. The clamp device 42, of course, is first readied as shown in FIG. 5, with the head member 70 disposed above the head member 72, and the head member 72 is positioned closely adjacent the stop 75.

The clamp device 42 is then placed with its planar surfaces 126 and 128 seated within and against the exterior of the web portion 22 (and between shoulders 24 and 26) of the panel side frame member to which the panel 14 is to be attached, and then shifted upwardly along such indented web portion 22 until the lobe 122 of the lower head member 70 is positioned more or less coextensively of such panel side frame indexing aperture 46, after which clamp device 42 is angled as needed (see FIG. 6) so that such lobe 122 may be entered into the indexing aperture 46, and clamp device 42 disposed so that at its groove 152 it rests on the lower edge 46A of same. The clamp device 42 is then swung back toward the side frame member 16 to bring the surface 126 of head 70 back into said engagement with the web portion 22 (of frame member 16), and shifted upwardly to bring the upper edge 46B of frame member 16 indexing aperture 46 into the V groove 140 of the lower head member 72, which raises the clamp device upper head member 70 to approximately the position shown in FIG. 7 with regard to the upper end 36 of the side frame 16. Thereafter, the clamp device 42 is dropped within the frame member 16 and positioned to again seat the indicated indexing aperture edge 46A in groove 152 of the lower head member 72, which brings the web portion 22 of the side frame member 16 in question, at the frame member upper end 36, into the groove 132 of the upper head member 70. This readies the clamp device for clamping application, to the side frame member 16, for securing to panel 12 the side frame member 18 of the panel 14 that is being applied to the mounted panel 12.

Referring now to FIG. 8, the side frame member 18 is applied to the seating hook finger portion 51, and its seating hook recess 86, by inserting the finger 51 through the indexing aperture 48 thereof, as indicated in FIG. 8. The panel 14 is then swung towards the panel 12 to bring the shoulders 24 and 26 of its side frame 18 against the corresponding shoulders 24 and 26 of the side frame member 16, which, during the course of this swinging movement, using the seating hook 44 at its recess 88 as a swinging connection, brings the web portion 22 thereof (of the indented frame member 18) against one or the other of the cam surfaces 138 or 146 of the respective head members 70 and 72 to achieve the side frame member shoulder seating action already indicated, which then permits the panel 14 being secured in place including its side frame 18 to be shifted upwardly so that the web portion 22 (of the indicated frame member 18) thereof enters the groove 134 of head member 70 (see FIG. 2).

As the seating hook marginal surfacings 94 defined by finger portion 51 are formed so that they will be in binding engagement with the indicated web portion 22 of frame member 18, this will result in the frame member 18 at its upper end 36 being disposed somewhat above the level 36 of the mounted panel side frame member 16.

The installer then uses a suitable conventional device for power operation of screw bolts to physically seat the indicated side frame member 18 in place, which normally involves an adapter of a conventional type involving the usual shank that is fixedly secured to the tool for rotating purposes, and a head having the usual hex shaped underside aperture proportioned to screw drivingly fit over bolt head 64. Assuming the power tool is so equipped and driven to turn bolt 62 to threadedly move head 72 toward head 70, heads 70 and 72 are directed against the web portion 22 of frame member 16, and web portion 22 of frame member 18, which drives the frame member 18 at seating hook 44 into binding engagement with the seating hook marginal surface 94; this driving action is continued until the upper ends 36 of the respective panel side frame members (16 and 18) are in essentially level relation.

Thereafter, the power tool is removed, leaving in place the clamp device 42 and seating hook 44 as well as the now secured in place panel 14, the side frame member 16 of which is held clamped against seating hook 44 by clamp device head 70.

Where either the bottom hook 44A or bottom hook 44B is employed instead of bottom hook 44, after application of the selected cast bottom hook to anchor same in place on the side frame 16 of the fixed panel 12, the panel securement procedure thereafter is the same as that described in connection with bottom hook 44.

The panel wall resulting by the securement of the panel 14 to the freestanding panel 12 may be further extended by repeating the procedure indicated for adding additional panels 14 thereto, using a separate clamp device 42 and one of the seating hooks 44, 44A, or 44B for each panel so added; the panels 14 so added and the length of the panel wall so provided will be determined by the use to which the work station or the like is to be put. As indicated, right angle corners, or the like, may be formed by using suitably contoured filler posts having the securing sides of same formed to approximately and appropriately define the configurations of the illustrated side frame members 16 and 18, with a set forming separate clamp device 42 and one of the hereindisclosed seating hooks being used for each such post, and a similar set being employed on such post for starting a fresh panel wall. Using similar but appropriately contoured posts, space subdivider system configurations of the "X", "T", and other conventional configurations may thus be readily put together by the installer.

FIG. 9 illustrates a modified form of the arrangement 40A, in which compression spring 73 is eliminated, and instead a compression spring 235 is interposed between the body or head member 70 and bolt head 64, or washer 116 in the specific form of FIG. 9.

In the modified form of FIG. 10, the arrangement 40B includes both springs 73 and 235.

The arrangements 40A and 40B are otherwise the same as arrangement 40.

It will be apparent that the panels of a work station or the like space subdividing system assembled by the practice of the present invention may be disconnected by releasing the clamp devices 42 and removing same and the seating hook version used in connection with same, without damaging the panels involved. Thus, this invention permits not only ready installation of the work station or the like, but also ready disassembly, moving of its component parts, and reassembly of same at a new location if so desired. Optionally removable blank corners may thus be employed for these and other side frame apertures that may be involved.

Also, by appropriately locating the indexing apertures 46, 48 and 50 in set form in the panel side frame members of panels used in a particular work station or the like, panels of varying lengths may be secured together as desired.

It will also be apparent that the clamp device 42 may be not only premounted as indicated on the free standing panel 12, but also it may be premounted on a panel 14, or a filler post of the type indicated and employed in the manner indicated in conjunction with one of the seating hooks hereindisclosed, to practice the present invention.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In demountable wall panel space divider systems that include a freestanding panel that is vertically disposed in freestanding relation and includes at, at least one side edging of same, a rectilinear vertically disposed side frame member in the form of a side channel having upper and lower ends and defining a planar web extending longitudinally of such member, with such web being indented toward such panel and disposed between a pair of spaced apart coplanar side frame member shoulders extending longitudinally of such side frame member and each such shoulder defining a planar surfacing facing oppositely of the indentation of such web, for use in securing to such panel, at such side frame member of same, an unattached elongate member defining along one side of same a planar web indented inwardly thereof and disposed between a pair of spaced apart coplanar shoulders dimensioned transversely of the unattached member approximately the dimensioning of such panel side frame member shoulders transversely of such panel side frame member, with each of such unattached elongate member shoulders defining a planar surfacing facing oppositely of the indentation of the elongate member, by disposing such elongate member in position for securing same to such panel side frame member, including vertically disposing such unattached member to define upper and lower ends and disposing such shoulders of such freestanding panel side frame member in aligned abutting relation with such shoulders of such elongate member between such ends of such elongate member, and free of any standard between such freestanding panel side frame member and such elongate member;

a panel connector arrangement therefor that also subjects such elongate member to compression within the length thereof and permits adjustment movement of such elongate member longitudinally of such side frame member under said compression, said panel connector arrangement comprising:

a first indexing aperture formed in the lower portion of such freestanding side frame member between such shoulders thereof, a first indexing aperture formed in the lower portion of such elongate member between such shoulders thereof, said indexing apertures being spaced substantially the same distance above the lower ends of such panel side frame member and such elongate member, respectively, a seating hook, means for fixing said seating hook to such panel side frame member adjacent said first indexing aperture thereof and between such shoulders thereof, with said seating hook being proportioned and positioned such that when such elongate member is disposed for securement to such panel side frame member, said seating hook projects through said first indexing aperture of such elongate member and in frictional binding but movement accommodating relation to such elongate member longitudinally thereof, a clamp device for application to one of such members above said seating hook prior to disposing such elongate member for securement to such panel side frame member, said clamp device being proportioned to extend longitudinally of and be disposed between such indented portions of such webs of such members, said seating hook being in discrete relation to said clamp device, a second indexing aperture formed in such freestanding panel side frame member between such shoulders thereof and above said first indexing aperture thereof, a second indexing aperture formed in such elongate member between such shoulders thereof and above said first indexing aperture thereof, said second indexing apertures being of substantially equal size and being positioned for substantial horizontal alignment when said seating hook is in said binding relation to such elongate member, said clamp device comprising:

upper and lower spaced apart cross heads proportioned so that when such members are disposed in such securing position, said cross heads are disposed transversely of such panel side frame member and such elongate member, respectively, with said lower cross head disposed through said second indexing apertures when the latter are in said horizontal alignment, and said upper cross head disposed above aid lower cross head and positioned for application of thrust to such panel side frame member and such elongate member, respectively, acting longitudinally thereof, and means for shifting said upper cross head toward said lower cross head for effecting movement of such elongate member longitudinally thereof under said binding relation of said seating hook with such elongate member, one of said clamp device cross heads being formed to maintain the shoulders of such panel side frame member and such elongate member in such abutting relation on and after operation of said shifting means.

2. In demountable wall panel space divider systems that include a freestanding panel that is vertically disposed in freestanding relation and includes at, at least one side edging of same, a rectilinear vertically disposed side frame member in the form of a side channel having upper and lower ends and defining a planar web extending longitudinally of such member, with such web being indented toward such panel and disposed between a pair of spaced apart coplanar side frame shoulders extending longitudinally of such side frame member and each such shoulder defining a planar surfacing facing oppositely of the indentation of such web, for use in securing to such panel, at such side frame member of same, an unattached panel that includes at, at least one side of same, an elongate member defining along one side of same a planar web indented inwardly thereof and disposed between a pair of spaced apart coplanar shoulders dimensioned transversely of the unattached panel member approximately the dimensioning of the freestanding panel side frame member shoulders transversely of the freestanding panel side frame member, with each of the unattached panel elongate member shoulders defining a planar surfacing facing oppositely of the indentation of the unattached panel elongate member, by vertically disposing such unattached panel so that such member thereof defines upper and lower ends and the shoulders of the freestanding panel side frame member are disposed in aligned abutting relation with the shoulders of the unattached panel elongate member between such ends of such unattached panel elongate member, and free of any standard between the freestanding panel side frame member and such unattached panel elongate member;

a panel connector arrangement therefor that also subjects such unattached panel elongate member to compression within the length thereof and permits adjustment movement of such unattached panel elongate member longitudinally of such freestanding panel side frame member under said compression, said panel connector arrangement comprising:

a first indexing aperture formed in the lower portion of the freestanding side frame member between such shoulders thereof, a first indexing aperture formed in a lower portion of the unattached panel elongate member between such shoulders thereof, said indexing apertures being spaced substantially the same distance above the lower ends of such panel side frame member and such elongate member, respectively, a seating hook, means for fixing said seating hook to such freestanding panel side frame member adjacent said first indexing aperture thereof and between such shoulders thereof, with said seating hook being proportioned and positioned, when such shoulders of such freestanding panel side frame member and such elongate member, respectively, are brought into such abutting relation, to project through said first indexing aperture of such elongate member and be in frictional binding but movement accommodating relation to such elongate member longitudinally thereof, a clamp device for application to such freestanding panel side frame member above said seating hook and between the shoulders of such freestanding panel side frame member, prior to such vertical disposition of such unattached panel, said clamp device being proportioned to extend longitudinally of and be disposed between such indented portions of such webs of such members, said seating hook being in discrete relation to said clamp device, a second indexing aperture formed in the freestanding panel side frame member between such shoulders thereof and above said first indexing aperture thereof, a second indexing aperture formed in such elongate member between such shoulders thereof and above said first indexing aperture thereof, said second indexing apertures being of substantially equal size and being positioned for substantial alignment horizontally of such elongate member, when such seating hook is in said binding relation to said elongate member, said clamp device comprising:

upper and lower, spaced apart, cross heads proportioned so that when disposed transversely of the freestanding panel side frame member and such elongate member, respectively, said lower cross head may be disposed through said second indexing apertures when the latter are in said aligned relation, and said upper cross head may be disposed crosswise of and in thrust applying relation to the freestanding panel side frame member and such elongate member, respectively, and above said lower cross head, and means for shifting said upper cross head, when said lower cross head is disposed in said second indexing apertures and said upper cross head is disposed in said crosswise relation to the panel side frame member and such elongate member, toward said lower cross head for effecting said movement of such elongate member longitudinally thereof under said binding relation of said seating hook with the elongate member, one of said clamp device cross heads being formed to maintain the shoulders of such freestanding panel side frame member and such elongate member in such abutting relation on and after operation of said shifting means.

3. The panel connector arrangement set forth in claim 2 including:

means for biasing said cross heads apart against the action of said shifting means.

4. The panel connector arrangement set forth in claim 3 wherein said shifting means comprises:

a screw member rotatably mounted as to said upper cross head and threadedly connected to said lower cross head, said screw member having a stop head below said lower cross head and a screw actuating head above said upper cross head.

5. The panel connector arrangement set forth in claim 4 wherein:

said screw member actuating head is configured for powered rotation of said screw member relative to said cross heads.

* * * * *